US005711037A

United States Patent [19]

Reichardt et al.

[11] Patent Number: 5,711,037

[45] Date of Patent: Jan. 27, 1998

[54] WATERLESS URINAL

[75] Inventors: Klaus H. Reichardt, Encinatas; Ditmar L. Gorges, Los Angeles, both of Calif.

[73] Assignee: Waterless Company, Del Mar, Calif.

[21] Appl. No.: 512,453

[22] Filed: Aug. 8, 1995

Related U.S. Application Data

[63] Continuation-in-part of Ser. No. 52,668, Apr. 27, 1993, abandoned.

[51] Int. Cl.[6] ..... A47K 11/12

[52] U.S. Cl. ..... 4/301; 4/144.1; 4/679

[58] Field of Search ..... 4/144.1, 301, 302, 4/303, 309, 310, 311, 462, 679, 681, DIG. 11, 288, 290, 292, 293, 306; 137/247, 247.11, 247.27, 247.31, 247.33, 247.35, 247.39, 247.49, 362

[56] References Cited

U.S. PATENT DOCUMENTS 4,418,038 11/1983 Theeuwes ..... 422/37

FOREIGN PATENT DOCUMENTS 2629527 1/1978 Germany ..... 4/301
0242552 10/1946 Switzerland ..... 4/301
0329670 5/1958 Switzerland ..... 4/301
0655341 4/1986 Switzerland ..... 4/301
1449130 9/1976 United Kingdom ..... 4/301

*Primary Examiner*—Robert M. Fetsuga
*Attorney, Agent, or Firm*—J. E. McTaggart

[57] ABSTRACT

A waterless urinal meeting U.S. sanitation code requirements and providing advantages of cost savings, water conservation and easy maintenance is particularly beneficial in public or institutional urinal facilities. An odor trap cartridge unit is configured as a coaxial dual chamber bell trap that eliminates the need for conventional P or J type traps required in water-flushed urinals. In the odor trap, a body of oily liquid sealant, floating on a body of trapped residual urine, serves as an odor barrier but allows entering urine to immediately permeate downwardly through the sealant and proceed to a drain without requiring flushing. The odor trap is molded from two plastic parts that are assembled together to form a cartridge unit that fits readily into a receptacle cavity of urinal bowl configured for wall mounting. The cartridge stays in place by friction and gravity, and can be easily removed with a special tool. A special low specific gravity sealant formulation, ensuring efficient operation, is made biodegradable to protect the environment against any traces escaping to the drain. Sealant replenishment, when required, is easily performed. For unusually frequent usage, maintenance may be reduced by the use of an auxiliary oil reservoir serving one or more urinals.

3 Claims, 5 Drawing Sheets

WATERLESS URINAL

The present application is a continuation-in-part of abandoned application 08/052,668 filed Apr. 27, 1993 by the same inventors.

FIELD OF THE INVENTION

The present invention relates to urinals which require no flushing liquid, and more particularly it relates to improvements relating to efficiency and low maintenance in urinal odor traps which utilize an oily liquid as a sealant.

BACKGROUND OF THE INVENTION

With increasing emphasis on water conservation, there is renewed interest in toilets and urinals designed to minimize the amount of water consumed in flushing to mitigate excessive demands on water supplies as well as on wastewater disposal systems, both of which have tended to become overloaded with increasing populations.

Sanitation codes require urinals to provide an odor seal to contain gasses and odors which develop in the drain system: this function is conventionally performed by the well known P-trap or S-trap in which the seal is formed by a residual portion of the flushing water.

PRIOR ART

A wastewater pipe S-trap into which a disinfectant or deodorizer is introduced was disclosed in U.S. Pat. No. 303,822 to D'Heureuse.

German patent 318264 to Ziegler and Swiss patent 329,670 to Eisenwerke exemplify coaxial bell-trap configurations that operate in a conventional manner without any special liquid sealant: this category in general, i.e. bell, J or P traps where the only odor seal is formed by residual effluent, requires water-flushing to meet urinal sanitation regulations due to odors from the residual effluent when this is urine, thus the use of this category is generally restricted to water-flushed urinals and "greywater" applications such as kitchen sinks.

A urinal disclosed in U.S. Pat. No. 4,244,061 to Webster et al. uses no oil and is intended as a waterless urinal, as distinguished from the above described periodically-flushed trough urinals. The Webster urinal does not use an oily liquid barrier; instead it relies on a small "plug flow" entrance opening associated with a P trap, and is based on the premise that "the urine in the trap during normal use will be fresh and therefore without unpleasant odour".

Examples of bell trap structures that, like ordinary P- or J-traps, utilize only a residual trapped body of wastewater as the odor seal and are not intended or shown to utilize any special liquid sealant, are found in German patents 318264 to Ziegler and DE 26 29 527 A to Louis, and Swiss patents 228398 and 242552 to Ernst. These are characterized by metal construction from a plurality of metal parts including a cap/partition part that is retained in place only by gravity so as to make the parts readily dissemblable for cleaning purposes.

Odor traps trademarked SYSTEM-ERNST, related to the above mentioned Ernst patents, have found public use in Europe: typically the odor trap is mounted beneath floor level and embedded in a concrete swale that is periodically flushed. This type of stall urinal, while still in use in parts of the world, is no longer recognized in U.S. building and sanitation codes.

Swiss patent 604,657 to Wanner and German patent 1 609 233 to Ernst disclose respective forms of three-piece coaxial metal bell siphon traps with a body of disinfectant, denser than urine, disposed at the bottom of the liquid chamber.

The use of an oil as a recirculated flushing medium in a toilet system was disclosed in U.S. Pat. No. 3,829,909 to Rod et al.

The use of oil in toilets to form an odor trap has been disclosed in German patent 121356 to Beck et al. and in U.S. Pat. Nos. 1,050,290 to Posson and 4,028,747 to Newton.

In the category of bell traps utilizing oily liquid sealant, German patent 72361 and British patent 16,447 to Beetz in 1891 disclosed a urinal odor trap configured as a three-part cast iron coaxial bell trap having a generally cylindrical liquid compartment divided by a tubular partition into an inner compartment surrounding a drain tube and an outer entry compartment containing a sealant barrier of oily liquid through which urine permeates downwardly past the partition, upwardly through the inner compartment where it overflows the drain tube and exits downwardly to an external drain system. The Beetz device was not utilized or intended as a waterless urinal: it was used in European stall urinals of that time era which were periodically flushed down with water. The Beetz patent teaches daily disassembly and hand cleaning of the three trap parts and replacement of the liquid sealant. Such short service life of the sealant, which would be totally unacceptable in the field and objectives of the present invention, is believed to be attributable to the unavailability and lack of knowledge of suitable materials both for the liquid chamber itself and for the sealant, at that time era, about 100 years ago. The adverse properties of the cast iron material, i.e. tenancy to corrode and contaminate, inefficient shaping and proportioning of the trap configuration, shortcomings of the formulation of the liquid sealant, and additionally the adding of disinfectant, all combined adversely to necessitate the frequent cleaning taught by Beetz, thus motivating the three-piece structure that was easily disassembled for the daily cleaning. Unfortunately, Beetz' structure places an interface joint between the main chamber bottom and the drain tube, held together by only gravity (weight of the cap/partition on the drain tube) acting to keep it sealed. Leakage at this joint, which is highly likely, allows sealant to escape down the drain, further aggravating the unsatisfactory maintainability. Further Beetz taught adding disinfectant, apparently unaware of the potential performance degradation from reaction with the sealant and the urine/water in a manner that breaks down their critical ability to remain separated.

Swiss patent 655,341 A5 to Louis discloses a basically two-piece coaxial odor trap structure, characterized structurally as having a cap/partition part unattached around its periphery, supported instead at the bottom of the partition (23, 123) by a plurality of support ribs (19, 119) and secured thereto by a pin (26, 126). The structure is further characterized in that at least the outer wall bordering the pot-like lower part consists of a malleable plastic whereas the upper part is of a rigid construction.

British patent 1 449 130 to Jenkins discloses a set of parts for a special multi-chamber oil-filled siphon-pot odor trap structure for urinals not provided with water flushing.

Although the general principles of bell traps and oily liquid seals have been known for over a hundred years, waterless urinals based on these principles have met with only limited acceptance abroad and virtually none in the United States. This failure has been due to a combination of circumstances: established restrictive sanitation regulations, time-honored custom and acceptance of water-flushing as the norm, resistance to change, technological shortcomings, e.g. lack of suitable modern plastic materials for the bell trap structure, lack of a well-developed highly efficient oily liquid composition, a failure to fully understand and effectively exploit the underlying principles and subtleties of water/oil separation along with the consequent past history of excessive maintenance requirements due to such factors as unsatisfactory materials, loss of sealant both in service and through faulty interface joint seals, and most importantly, an abundance of low cost water in the past which has allowed the almost universal monopoly of water-flushed urinals to go unchallenged for over a century.

However more recent real and threatened water shortages, along with heightened environmental awareness and public outrage over unbalanced public budgets, have opened up vast potential for an improved and now viable waterless urinal odor trap.

OBJECTS OF THE INVENTION

It is a primary object of the present invention to provide an improved flushless urinal of the bell trap oil seal type.

It is a further object that the urinal be economical and easy to manufacture.

It is a still further object for the urinal to eliminate the need for a P-trap in the drain line, and to meet U.S. sanitation standards.

It is a still further object for the urinal to be constructed and arranged to minimize maintenance requirements.

SUMMARY OF THE INVENTION

The above objects have been met in the present invention of a coaxial oil-seal type urinal in which the trap configuration and the sealant have been optimized for high efficiency and low maintenance. The trap is formed from modern plastic material: it may be molded economically in two parts which are easily assembled together in a substantially detented manner, and optionally thermally bonded together, to form an economical permanent odor trap unit that is easily installed, functions with minimal maintenance and provides very substantial savings of water and overall cost, especially in public and institutional facilities. For heavy duty service where usage is extremely frequent, maintenance requirements can be alleviated by the use of an auxiliary oil reservoir serving one or more urinals.

BRIEF DESCRIPTION OF THE DRAWINGS

The above and further objects, features and advantages of the present invention will be more fully understood from the following description taken with the accompanying drawings in which.

DETAILED DESCRIPTION

Figure 1A:
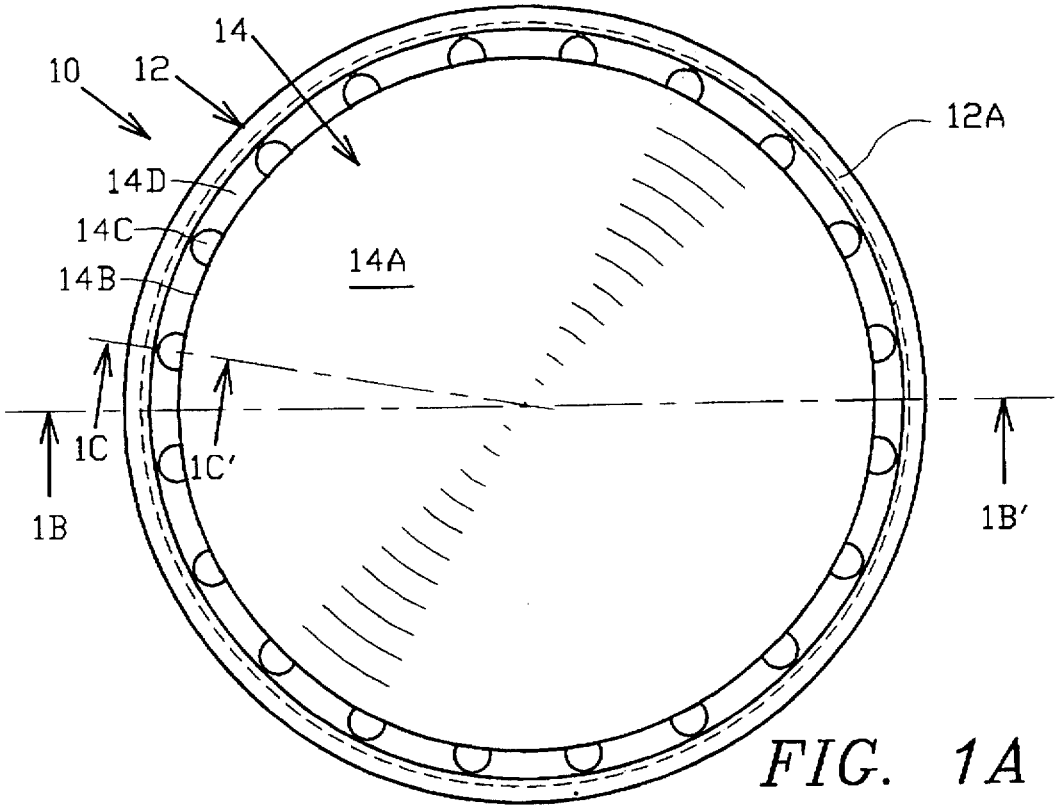
FIG. 1A is a top view of a preferred embodiment of a waterless urinal odor trap of the present invention.

FIG. 1A is top view of a waterless urinal odor trap unit 10 of the present invention in an illustrative embodiment which may be molded from plastic such as polyethylene or polypropylene. It can be injection molded in two parts: a cap/partition part 14 of which the cap portion 14A is visible, and a generally cylindrical main trap body 12 of which the top rim 12A is visible. Protruding from the main circumference 14B of the cap portion 14A are spacers 14C, patterned in a polar array, by which cap/partition part 14 is securely attached to the inner circumference of rim 12A. Between spacers 14C, a polar array of arched gaps 14D allow urine entry from above.

Figure 1B:
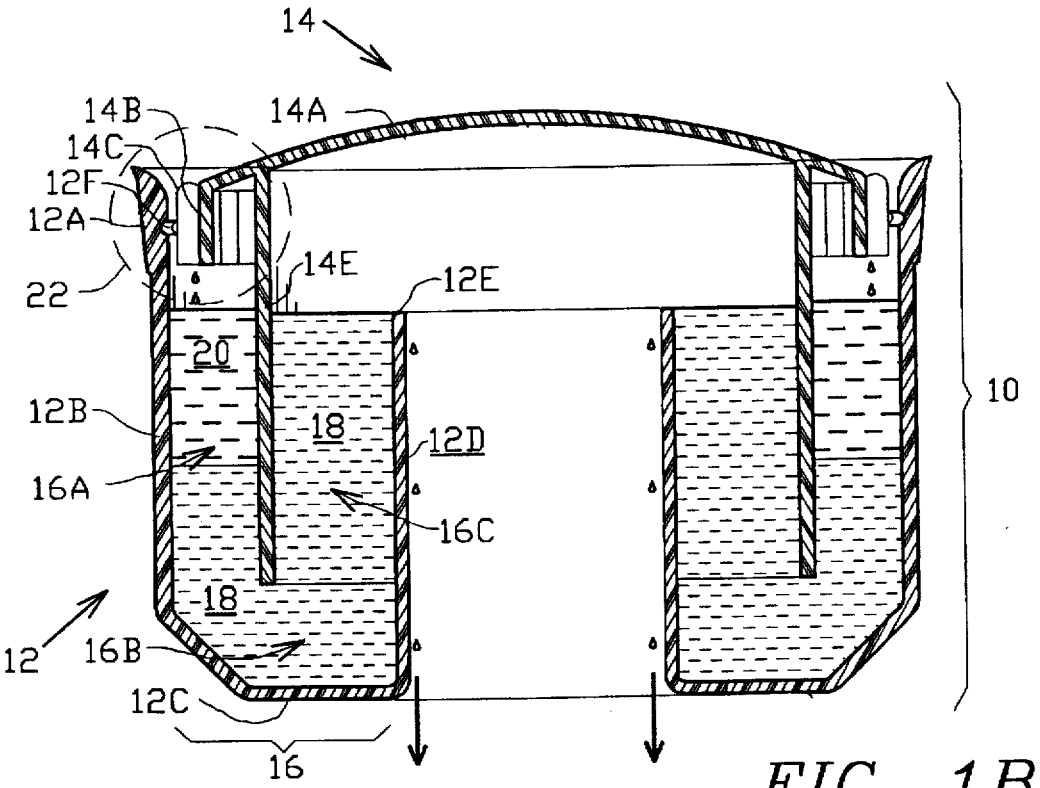
FIG. 1B is a cross-sectional view through axis 1B–1B' of FIG. 1A.

FIG. 1B is cross-sectional view of the unit taken through axis 1B–1B' of FIG. 1A. The two basic coaxial parts forming odor trap 10 are the main trap body 12 defined at the upper edge by rim 12A, and the cap/partition part 14 of which the cap portion 14A is seen shaped as a convex dome.

In the main trap body 12, from rim 12A a vertical main outer wall 12B extends downwardly; its lower extremity transitions via a chamfered portion to a generally flat horizontal bottom floor 12C, from which a central stand tube 12D extends upwardly to a top edge 12E, thus trap body 12 forms a coaxial main liquid chamber 16 that is integral and thus leak-proof, and that has a liquid drainage overflow level defined by the top edge 12E of stand tube 12D.

Cap portion 14A of cap/partition part 14 is formed to have a peripheral skirt 14B, running around the circumference, on which are formed cylindrical spacers 14C arranged in a polar array. Cap/partition part 14 is formed to provide an integrally-attached tubular partition 14E extending downwardly and dividing the liquid chamber 16 into three general regions: an outer chamber region 16A that extends downwardly to the bottom edge of partition 14E, a bottom chamber region 16B at levels below partition 14E and an inner chamber region 16C extending from the bottom of partition 14E to the overflow level at the top edge 12E of stand tube 12D.

The inner and bottom chamber regions 16C, 16B and a portion of the outer chamber region 16A contain a body of watery effluent 18, typically urine which is principally water, while the upper portion of outer region 16A contains a body of oily sealant liquid 20 that has a specific gravity substantially lower than 1.0 (the s.g. of water) and preferably not exceeding 0.9 and which thus remains floating on the body of effluent 18, and forms an odor seal there, preventing the escape of odors of the effluent fluid 18 and gasses trapped in the region of stand tube 12D.

The lower extent of the body of liquid sealant 20 can vary in level and still function efficiently, ranging from a very thin layer to a full charge extending to the bottom of partition 14E: both conditions function satisfactorily, however a full charge is not recommended since there can be loss of liquid sealant 20 down the drain during initial arrival of urine. The recommended sealant charge level is approximately as shown.

Figure 1C:
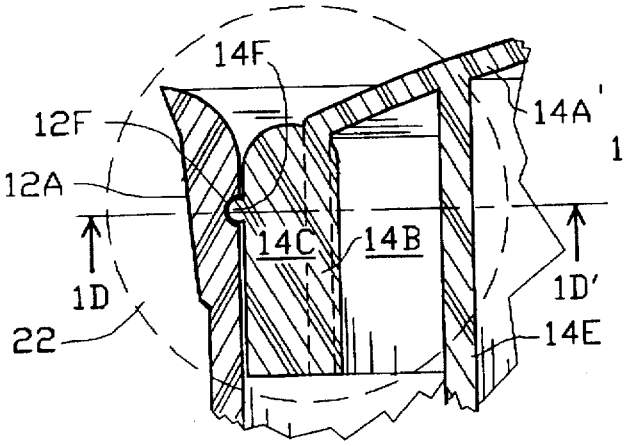
FIG. 1C is an enlarged cross-sectional view through axis 1C–1C' of FIG. 1.

FIG. 1C is an enlarged cross-sectional view taken in the general region in circle 22 (FIG. 1B) showing a cross-section taken through axis 1C–1C' (FIG. 1A) which bisects spacer 14C. Each spacer 14C is formed to have a central hemispheric detent dome 14F configured and dimensioned to detentedly engage an annular detent groove 12F of generally semi-circular cross-sectional shape formed around the inner wall of rim 12A. Spacer 14C is molded in intersection with the skirt in the form of an elongated cylinder, extending full height of skirt 14B shown in dotted outline, and having a hemispheric dome-shaped top end and a flat bottom end. At the upper portion of rim 12A, its outer and inner surfaces are both seen to flare outwardly to a point of convergence at the top edge; this flared shape of the inner surface serves to facilitate initial assembly by guiding domes 14F while the cap portion 14A is being inserted downwardly; rim 12A becomes increasingly stretched by outward pressure from domes 14F as the cap portion 14A is finally pushed into place where it becomes detentedly locked by domes 14F engaging detent groove 12F.

Figure 1D:
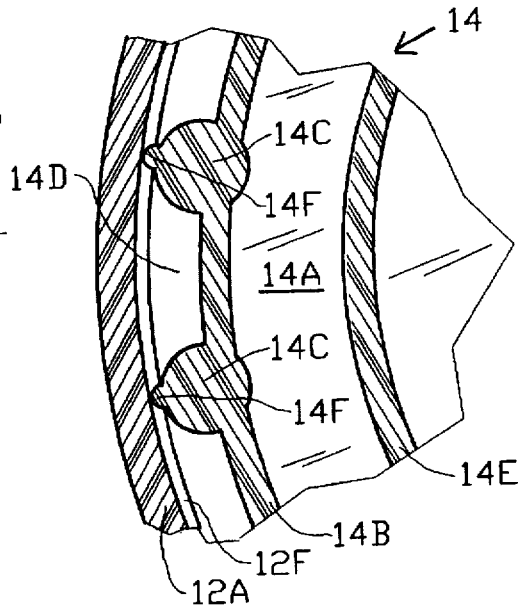
FIG. 1D is an enlarged cross-sectional view taken at 1D–1D' of FIG. 1C.

FIG. 1D is a cross-sectional view of a portion of cap/partition part 14 in the region shown in FIG. 1C, taken through axis 1D–1D'. The pair of spacers 14C are seen to each extending a small distance inwardly past skirt 14B; spacers 14C are formed to provide detent domes 14F engaging annular detent groove 12F formed around the inside of rim 12A.

Figure 2:
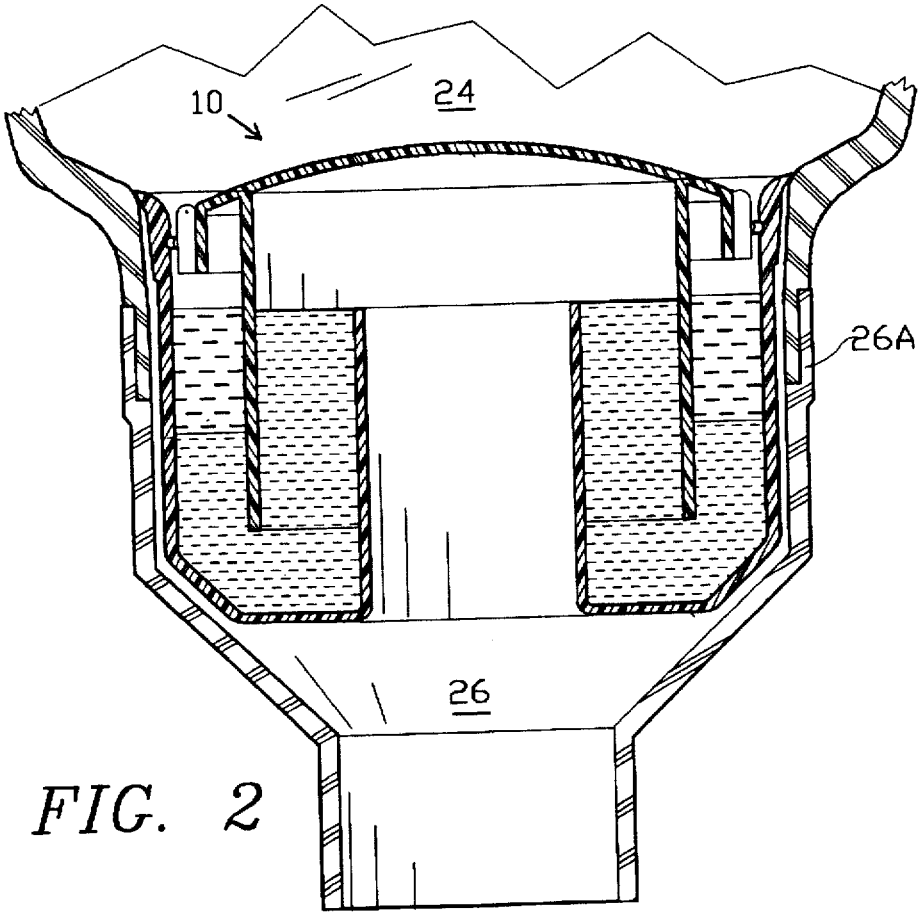
FIG. 2 is a cross-sectional view of the odor trap unit of FIG. 1 installed in a urinal bowl attached to a drainage housing.

In FIG. 2, the trap unit 10 is shown fitted into a close-fitting trap receptacle formed in urinal collector bowl 24, shown in part, having a circular lower extremity surrounding trap unit 10 and fitted to a reducer housing 26 that tapers to a designated size, typically 2", for attachment via standard plumbing to the waste water disposal system. Typically bowl 24 is joined, and typically bonded adhesively, at a lap joint 26A, which may be adhesively bonded, to reducer housing 26 which may be implemented by a standard ABS pipe reducer fitting, connected to the drain system. The urinal bowl 24 can be made of fiberglass-reinforced resin, e.g. polyester resin with fiberglass applied by chopper gun technique; the working surface can be a gel coat or an acrylic surface. Alternatively bowl 24 could be manufactured from other materials such as stainless steel, porcelain or plastic.

The upper rim edge of the odor trap 10 is shaped to contact the diverging trap receptacle region of bowl 24 as shown so as to automatically compensate for dimensional tolerances of the bowl 24 and trap unit 10: the trap unit 10 settles gravitationally so as to fit closely against the trap receptacle of bowl 24. An absolute seal is not required at this interface point since any leakage will still be contained within the drainage compartment and will proceed down the drain.

Figure 3A:
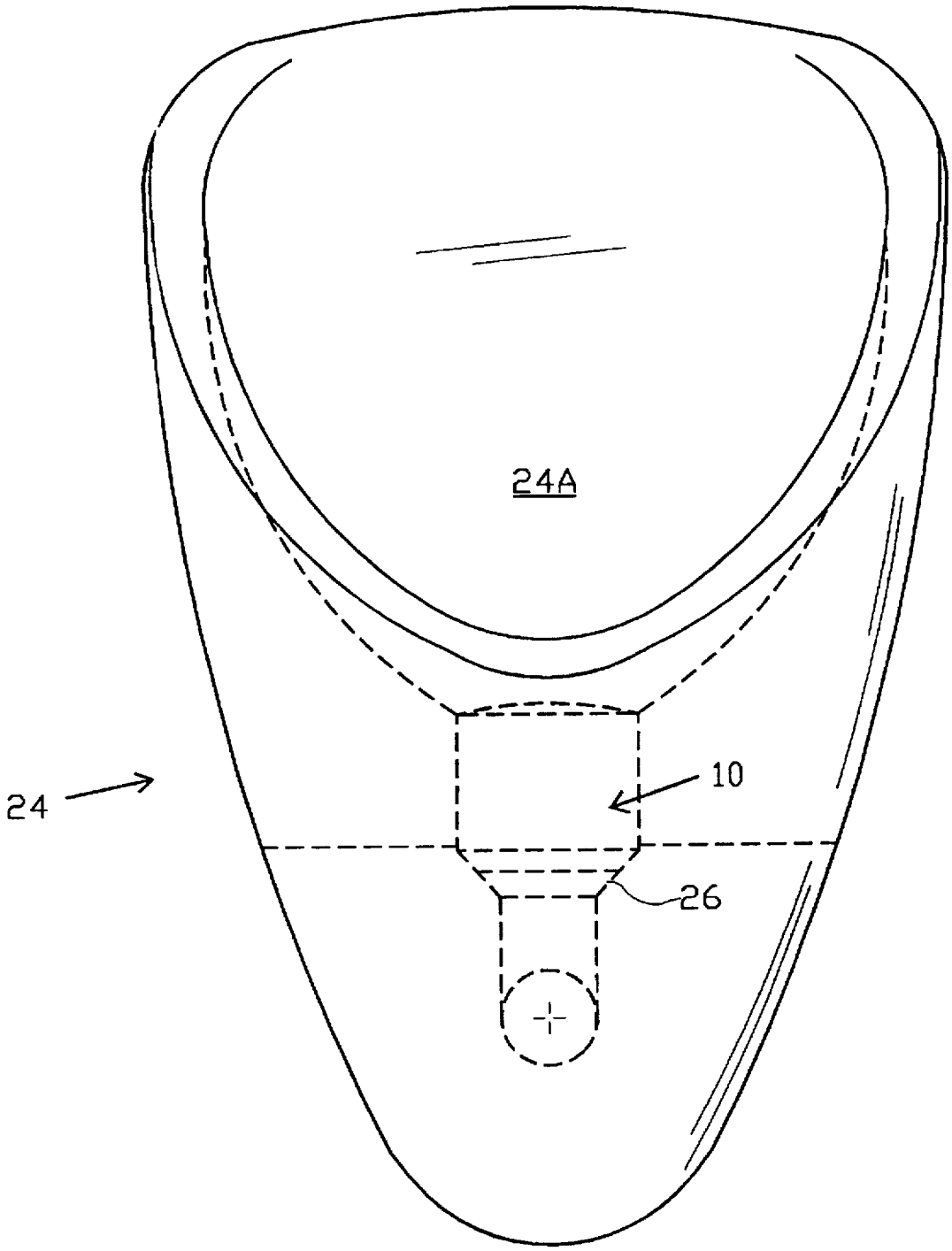
FIG. 3A is frontal elevation of a wall-mounted urinal utilizing an odor trap of the present invention.

FIG. 3A is a frontal elevational view of a urinal assembly 24 utilizing a waterless trap unit 10 of the present invention deployed with a reducer housing 26 as shown in FIG. 2. The bowl 24 is formed to provide an overall enclosure for wall mounting in addition to providing the urine collection bowl portion.

Figure 3B:
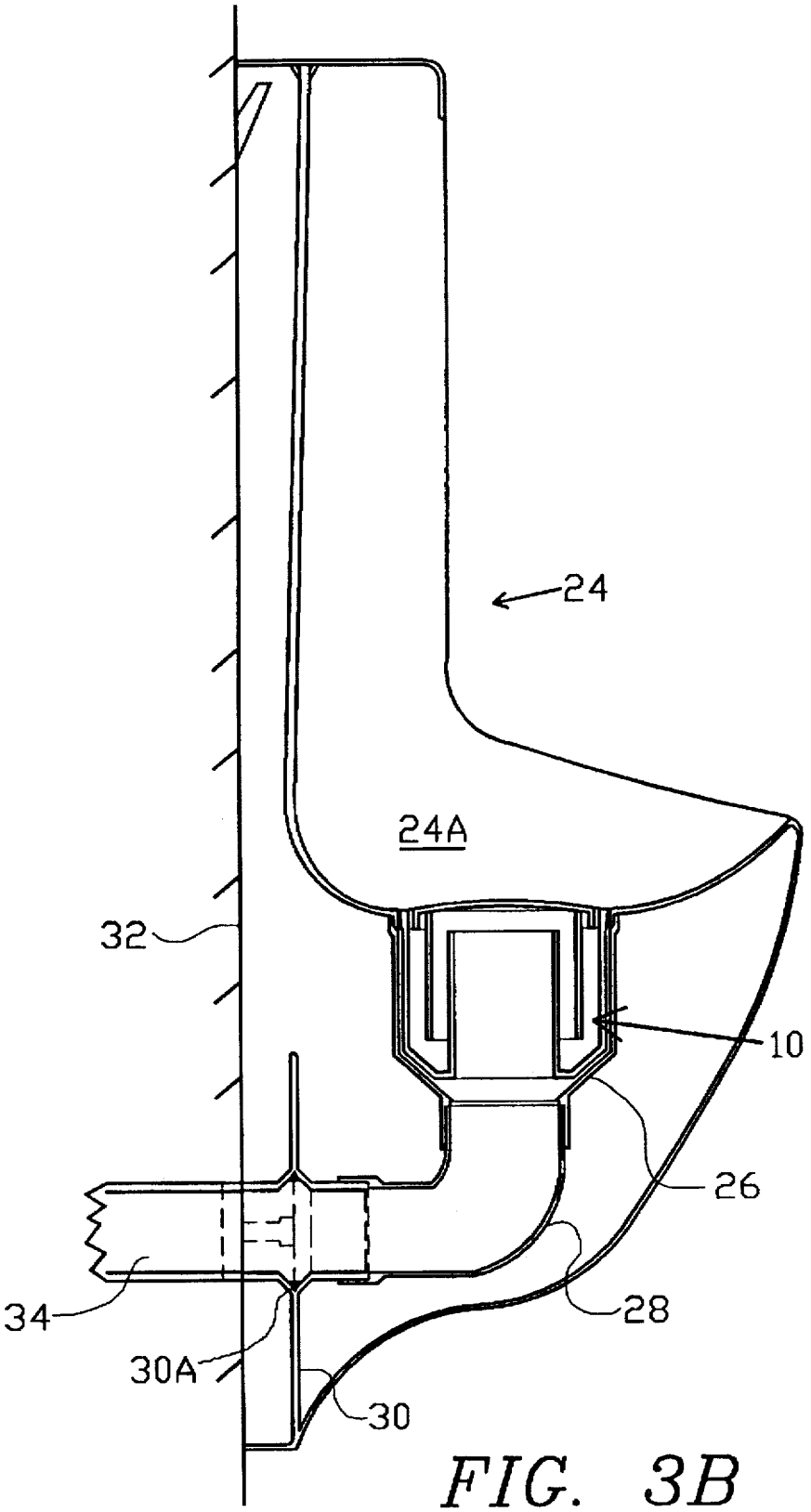
FIG. 3B is a side view of the subject matter of FIG. 3A.

FIG. 3B is a side view central cross-section of the urinal assembly 24 of FIG. 3A, with trap unit 10 retained within reducer housing 26 whose lower end is attached to a 90 degree drain pipe elbow 28, which in turn is attached to a standard plumbing flange 30 for typically bolted attachment including an O-ring seal 30A at the location shown, for attachment to a drainage fitting 34 installed in the building wall 32 which carries urinal 24. As a matter of design choice, it would be possible to utilize custom design and construction to eliminate one or more of the interface joints between the urinal bowl 24, the reducer housing 26, elbow 28 and flange plate 30 by combining two or more of these components by means of integral construction.

Referring again to FIG. 1B, in operation of odor trap 10, urine entering from above and running off from cap portion 14A falls onto the top surface of the oily liquid sealant 20, where, due to greater density, the urine immediately separates into small droplets that permeate downwardly in a turbulent flow through the sealant 20, the urine and the oily liquid sealant 20 remaining separated due to non-water-soluble properties of the sealant 20. The droplets exiting beneath sealant 20 gravitate downwardly into the body of effluent 18 where, due to displacement from newly-entering urine in outer chamber 16A, effluent 18 overflows the top edge 12E of stand tube 12D and exits down through the stand tube 12D to the external drain system. The body of sealant 20 remains in place, floating on top of the body of effluent 18 in the outer chamber 16A as shown.

In preparing odor trap 10 for service, water may be utilized initially as the effluent 18, to which the recommended charge of sealant 20 is added from above through arched gaps 14D. Sealant 20 may be replenished in the same manner.

As part of normal operation there is a small depletion of the sealant 20 during usage, as traces escape, so that replenishment of the sealant 20 may be required as a maintenance measure after a large number of operations, typically in the thousands. So that the escaping traces will not harm the environment, the sealant 20 is made biodegradable.

A preferred composition of sealant 20 comprises an aliphatic alcohol containing 9–11 carbons in the chemical chain: the specific gravity is 0.84 at 68 degrees. Since the operation of the odor trap is based on the differential between the specific gravity of sealant 20 and that of urine, typically near 1.0, the specific gravity of sealant 20 should be made as low as possible, preferably well under 0.9. It is preferred to color the sealant distinctively, e.g. with a blue coloring agent, for monitoring purposes.

Figure 4:
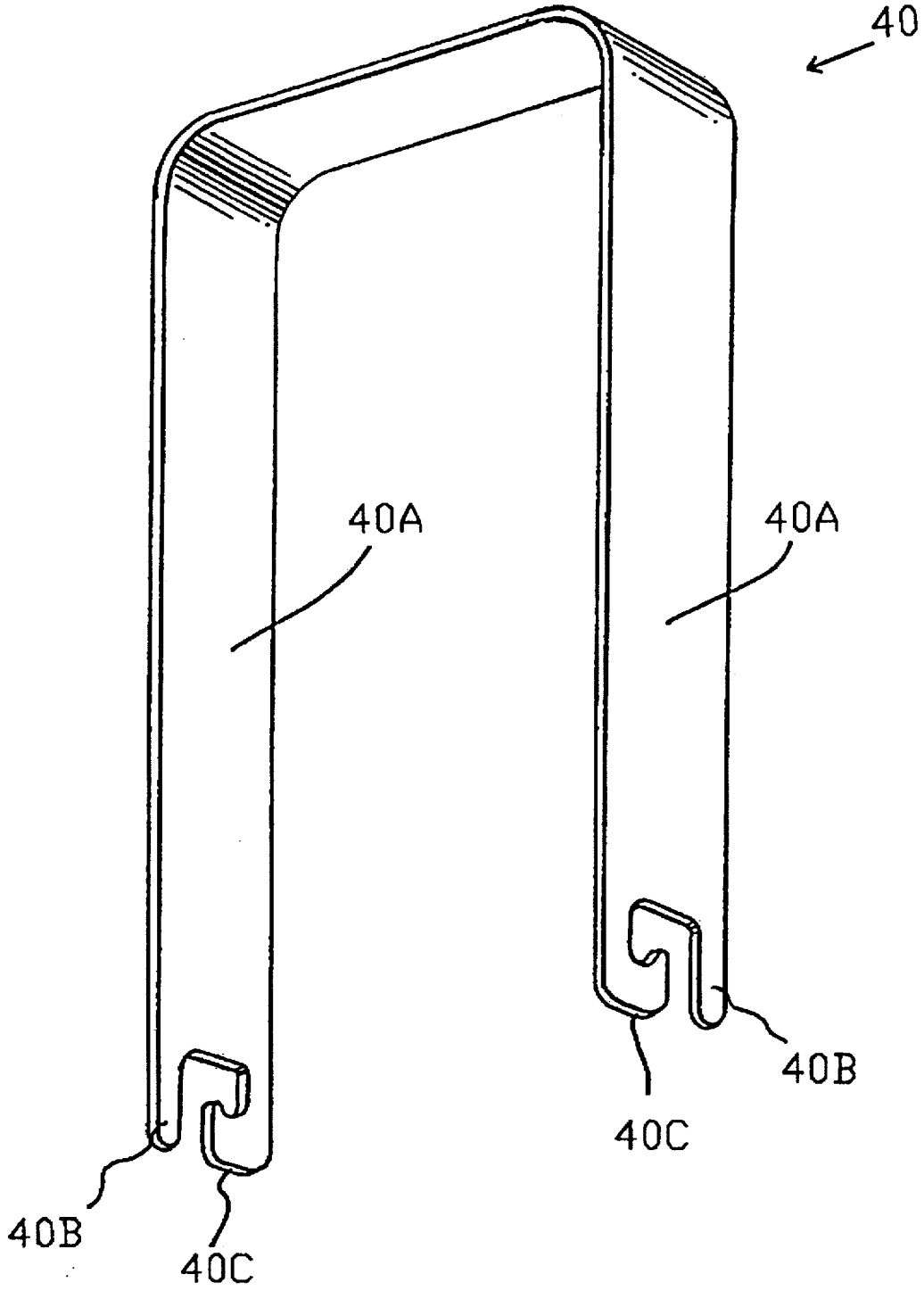
FIG. 4 is a three-dimensional view of a tool for extracting an odor trap of the present invention from an installed location in a urinal bowl.

FIG. 4 is a three-dimensional view of a tool 40, typically made of metal such as steel, for removing an odor trap 20 of the present invention from an installed location such as depicted in FIG. 2, in the event that removal may be desired or required. The spacing between the two parallel side members 40A is made equal to the spacing of a pair of diametrically opposite arched gaps 14D (refer to FIG. 1A). Ends of side members 40A are each formed with a straight tab 40B and hooked tab 40C separated by a slot as shown such that the ends can be inserted between the cap portion 14A and the rim 12A (FIGS. 1A, 1D) with the slots traversing a diagonally opposite pair of spacers 14C. Then with a small rotation, the hooked tabs 40C will engage the spacers 14C so the odor trap unit 10 can then be removed by pulling upwardly on the removal tool 40.

As important structural criteria, the relationships of the cross sectional liquid flow areas must be considered at three major portions along the flow path: outer chamber region 16A, bottom chamber region 16B and inner chamber region 16C. It is particularly important to make the height of the bottom chamber region 16B, as defined by the spacing of the lower edge of partition 14E above the floor 12C, sufficient to provide adequate cross-sectional flow area, as measured immediately under the partition 14E, to provide unimpeded inward radial horizontal liquid flow through the bottom chamber region 16B. Based on experience, the cross-sectional flow area in the bottom chamber region at that point should be made larger than the cross-sectional area of downward liquid flow in the outer liquid chamber 16A: this will provide a reserve to avoid blockage and or impairment of normal operation despite a certain amount of accumulation of debris, cigarette residue, etc., in the bottom liquid chamber region 16B. The partition 14E should be located to provide suitable proportioning of the cross-sectional liquid flow areas of the outer and inner chamber regions.

In a preferred embodiment as shown in FIG. 1B, the outer liquid chamber 16A, the partition 14E and the stand tube 12D are made approximately 11 cm, 8 cm, and 4 cm in diameter respectively, and the partition is located 2 cm above the floor: from these dimensions, the respective cross-sectional liquid flow areas of the outer chamber region, bottom chamber region and inner chamber regions are calculated to be approximately 45, 50 and 38 sq. cm. respectively, thus the flow area in the bottom chamber region is made about 10% larger than the flow area in the outer chamber region.

Failure to recognize and anticipate this requirement has frequently curtailed the efficiency and reliability of devices of known art, particularly where the structure requires placement of support vanes and the like in the bottom region, where such structure introduces the adverse effects of impeding the liquid flow and reducing the reserve flow capacity.

It is envisioned, in situations of extremely frequent usage, to add an auxiliary reservoir for holding a reserve supply of sealant 20 to extend the normal maintenance replenishment interval. A reservoir may be implemented in different forms; for example, (1) a communicating gravity system with a common surface level for the reservoir and (a) a single connected adjacent odor trap or (b) a plurality of connected odor traps connected to a remote reservoir by supply tubing, or (2) an elevated reservoir with supply tubing feeding one or more odor traps in a "drip" replenishment approach. The reservoir would be fitted with convenient filler means for adding sealant 20.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. An odor trap kit for a waterless urinal having a trap receptacle in a lower portion thereof, comprising:

an odor trap unit, constructed and arranged to be installed into the trap receptacle and to be retained there frictionally, comprising:

(a) a cylindrical main body part having an outer wall integrally joined via a common floor to a central stand tube extending upwardly to an overflow level, the outer wall extending upwardly beyond the overflow level to a rim region, thus forming a main liquid chamber, and (b) a cap/partition part having a cap portion with a partition, extending downwardly therefrom to a horizontal lower edge, constructed and arranged to divide the main liquid chamber into an inner chamber region surrounded by an outer chamber region, and to define a bottom chamber region, communicating with the inner and outer chamber regions, extending in height from the floor to the lower edge of the partition, the cap portion extending outwardly beyond the partition to a circumference configured with a plurality of spacers disposed in a uniform polar array extending radially so as to engage the rim region in a manner to attach said main body part to said cap/partition part, thus forming said odor trap unit as a cartridge to be installed in the trap receptacle, the spacers, cap and rim forming a polar array of arched gaps for directing urine from above downwardly into the outer chamber region of said main body part; and a generally U-shaped metal tool, having a pair of ends each shaped to have a hooked tab constructed and arranged to engage said odor trap unit by inserting the tabs through two diagonally opposite arched gaps and rotating the tool so as to engage a corresponding pair of the cylindrical spacers with corresponding hooked tabs, such that, subsequent to installation in the trap receptacle, the odor trap unit can then be extracted therefrom by pulling on said tool;

whereby, when the main liquid chamber contains watery effluent liquid up to the overflow level so as to form a drain trap, a layer of liquid sealant, formulated to repel the effluent liquid and to have a specific gravity lower than that of the effluent liquid, is enabled to float on the effluent liquid in the outer chamber region and to thus function as a sealed barrier that prevents release of odor from the effluent liquid.

2. A waterless urinal having an odor trap fitted into a bowl portion, the odor trap comprising:

a main body part having a cylindrical outer wall integrally joined via a coaxial circular common floor to an open central coaxial stand tube extending upwardly to an overflow level, the outer wall extending upwardly beyond the overflow level to a rim region, thus forming an annular main liquid chamber;

a cap/partition part having a horizontal circular shallow-domed cap portion disposed and attached coaxially within the rim of said main body part, and having an integrally-formed co-axial tubular partition, of smaller diameter than the cap portion and extending downwardly therefrom, constructed and arranged to divide the main liquid chamber into an outer chamber region and an inner chamber region surrounded by the outer chamber region, and to define a bottom chamber region, communicating with the inner and outer chamber regions, extending in height from the floor to the lower edge of the partition, said cap/partition part being configured with an integral annular skirt disposed around the outer circumference of the cap portion extending downwardly therefrom in a vertical direction and defining a predetermined uniform skirt height;

a plurality of spacers disposed peripherally in a uniform polar array around said skirt, said spacers extending radially to the inner circumference of the rim of the outer wall of said main body part, thus forming between the spacers a polar array of arched gaps constructed and arranged to provide entry of urine from above through the arched gaps into the outer chamber region of said main body part;

main assembly attachment means constructed and arranged to attach said cap/partition part peripherally to said main body part in a substantial manner so as to thus form said odor trap as an integral unit, said attachment means comprising:

said spacers being formed as portions of vertically-oriented elongated cylinders formed integrally in intersecting partial combination with said skirt, sized and disposed in general correspondence with the height of said skirt, the cylinders having a flat lower end and a hemispheric dome-shaped upper end, and having a major cylinder portion extending outwardly so as to constitute said spacers;

a plurality of hemispheric domes arranged in a polar array, formed one on each of said spacers, protruding radially outwardly therefrom;

a flared entry region, formed around the inner circumference of the rim of the main body part, constructed and arranged to facilitate initial assembly of the odor trap by providing a guidance surface for said domes;

an annular groove formed around the inner wall region of the rim of the outer wall of said main body part, engaging said domes in a detented manner, said domes and said annular groove being constructed and arranged to provide substantial detented attachment between said main body part and said cap-partition part; and, supplied with said odor trap, a generally U-shaped metal tool constructed and arranged to engage selected ones of said spacers in a manner to extract the odor trap from the trap receptacle of said urinal.

3. A waterless urinal having an odor trap fitted into a bowl portion, the odor trap comprising:

a main body part having a cylindrical outer wall integrally joined via a coaxial circular common floor to an open central coaxial stand tube extending upwardly to an overflow level, the outer wall extending upwardly beyond the overflow level to a rim region, thus forming an annular main liquid chamber;

a cap/partition part having a horizontal circular shallow-domed cap portion disposed and attached coaxially within the rim of said main body part, and having an integrally-formed co-axial tubular partition, of smaller diameter than the cap portion and extending downwardly therefrom, constructed and arranged to divide the main liquid chamber into an outer chamber region and an inner chamber region surrounded by the outer chamber region, and to define a bottom chamber region, communicating with the inner and outer chamber regions, extending in height from the floor to the lower edge of the partition, said cap/partition part further comprising an integral annular skirt disposed around the outer circumference of the cap portion extending downwardly therefrom in a vertical direction and defining a predetermined uniform skirt height;

plurality of spacers disposed peripherally in a uniform polar array around said skirt, said spacers extending radially to the inner circumference of the rim of the outer wall of said main body part, thus forming between the spacers a polar array of arched gaps constructed and arranged to provide entry of urine from above through the arched gaps into the outer chamber region of said main body part; a plurality of hemispheric domes arranged in a polar array, formed one on each of said spacers, protruding radially outwardly therefrom; a flared entry region, formed around the inner circumference of the rim of the main body part, constructed and arranged to facilitate initial assembly of the odor trap by providing a guidance surface for said domes; an annular groove formed around the inner wall region of the rim of the outer wall of said main body part, engaging said domes in a detented manner, said domes and said annular groove being constructed and arranged to provide substantial detented attachment between said main body part and said cap-partition part; and a generally U-shaped metal tool, having a pair of ends each shaped to have a hooked tab and an adjacent straight tab, constructed and arranged to engage said odor trap unit by inserting the tabs through two diagonally opposite adjacent pairs of the arched gaps and rotating the tool so as to engage a corresponding pair of the cylindrical spacers with corresponding hooked tabs, such that, subsequent to installation in the trap receptacle, the odor trap unit can then be extracted from the trap receptacle by pulling on said tool.

* * * * *